US005775236A

United States Patent [19]

Fenn et al.

[11] Patent Number: 5,775,236

[45] Date of Patent: Jul. 7, 1998

[54] COMBUSTION CONTROL CIRCUIT OF COMBUSTION APPARATUS

[75] Inventors: Gordon William Fenn, Brevard, N.C.; Young Moon Ryoo, Ansan; Hong Jib Kim, Incheon, both of Rep. of Korea

[73] Assignee: Haitai Electronics Co., Ltd., Incheon, Rep. of Korea

[21] Appl. No.: 745,703

[22] Filed: Nov. 12, 1996

[30] Foreign Application Priority Data

Nov. 20, 1995 [KR] Rep. of Korea ..... 95-42316

[51] Int. Cl.[6] ..... F23N 5/02; F23N 5/18

[52] U.S. Cl. ..... 110/185; 431/12; 431/24

[58] Field of Search ..... 431/12, 24, 36; 110/185

[56] References Cited

U.S. PATENT DOCUMENTS

| | | | |
|---|---|---|---|
| 4,133,629 | 1/1979 | Clark | 431/12 |
| 4,375,950 | 3/1983 | Durley, III | 431/12 |
| 4,455,656 | 6/1984 | Tanaka et al. | 431/24 |
| 5,158,024 | 10/1992 | Tanaka et al. | 110/185 |
| 5,503,183 | 4/1996 | Fenn et al. | 137/597 |
| 5,526,776 | 6/1996 | Fenn et al. | 122/367.3 |

*Primary Examiner*—Harold Joyce
*Assistant Examiner*—Gregory Wilson
*Attorney, Agent, or Firm*—Dougherty & Dremann

[57] ABSTRACT

There is disclosed a combustion control circuit of a combustion apparatus with a driving signal generator, an exhaust fan controller and a gas valve controller, including: a combustion state detector for detecting the state of combustion occurring within a combustion chamber according to an output signal of a flame sensor installed in the combustion chamber, and for producing a signal corresponding to the state of combustion; a reference signal generator for producing a reference signal in response to each output signal of a temperature sensor and a flow sensor; a comparator for comparing the output signal of the combustion state detector with the output signal of the reference signal generator, and for outputting a signal corresponding to a difference therebetween; and an adder for adding the output signal of the comparator to the output signal of the driving signal-generator, and for respectively applying an output to each one of the exhaust fan controller and the gas valve controller.

1 Claim, 2 Drawing Sheets

COMBUSTION CONTROL CIRCUIT OF COMBUSTION APPARATUS

BACKGROUND OF THE INVENTION

The present invention relates to a combustion control circuit of a combustion apparatus used for a boiler, an instant hot-water supply equipment and the like. More particularly, it relates to such a combustion control circuit of a combustion apparatus that may be capable of controlling an exhaust fan and a gas valve by detecting the actual state of combustion within its combustion chamber for the purpose of compensating for a difference between the actual state of combustion and its reference state.

A combustion apparatus that allows gas to burn to produce heat is generally included in a boiler, an instant hot-water supply equipment and the like. The heat produced by the combustion apparatus is used to heat up water for a hot-water boiler or a hot-water supply equipment. In order to control the temperature of water, the calorific power of the combustion apparatus is controlled by changing the amount of gas and air supplied to the combustion apparatus. In other words, the amount of gas and air supplied to the combustion apparatus should be increased to enhance the calorific power of the combustion apparatus in such a manner that the temperature of water is raised. When lowering the temperature of water, the amount of gas and air supplied to the combustion apparatus is reduced to decrease the calorific power of the combustion apparatus. In addition, the mixture ratio of applied gas and air should be controlled to make the combustion state optimum. The mixture ratio of gas and air for optimal combustion is determined through experiments.

A conventional combustion control circuit of a combustion apparatus includes, as shown in FIG. 1, a controller 1 that controls the overall circuit, a temperature sensor 2 that senses the temperature of water and provides to the controller 1 an electrical signal corresponding to the temperature of water, and a flow sensor 3 that senses a flow of water and provides to the controller 1 an electrical signal corresponding to the flow of water. The conventional combustion control circuit also includes an exhaust fan 4 that is actuated by the controller 1 to provide air whose amount is adequate to the combustion apparatus, and a gas valve 5 that is operated by the controller 1 to provide gas whose amount is adequate to the combustion apparatus.

The temperature sensor 2 and the flow sensor 3 are provided to the hot-water pipe to sense the temperature of hot water and the flow of water, and the exhaust fan 4 installed in a discharge path of exhaust gas allows the exhaust gas to escape from the combustion apparatus and, at the same time, provides air to the combustion apparatus. The gas valve 5 is supplied to a gas pipe connected to the combustion apparatus so as to control the amount of gas.

The following description concerns a conventional method for controlling combustion by means of the above combustion control circuit.

Once the combustion apparatus is actuated, the controller 1 receives electrical signals corresponding to the temperature of water and a flow of it from the temperature sensor 2 and the flow sensor 3. Subsequently, the controller 1 allows the exhaust fan 4 and the gas valve 5 to operate in response to the electrical signals produced from the temperature sensor 2 and the flow sensor 3. The bigger a difference between a set temperature of water and the actual one of water becomes, and the larger the flow of water is, the higher opening degrees of the gas valve 5 become, and the higher the rotating speed of the exhaust fan 4 becomes so that a large amount of gas and air can be supplied to the combustion apparatus. In other words, when the difference between the set temperature of water and its actual one is big and the flow of water is large, it is necessary to supply a large amount of gas and air to the combustion apparatus, since a great amount of heat should be applied to a heat exchanger that heats up water.

According to the conventional method for controlling combustion, the exhaust fan 4 and the gas valve 5 are controlled according to the difference between the set temperature of water and its actual one that the temperature sensor 2 measures and the flow of water that the flow sensor 3 finds. This conventional combustion control circuit, however, controls the exhaust fan 4 and the gas valve 5 without regard to the actual state of combustion that occurs within the combustion chamber, and it is difficult to control the temperature of water to a set point.

When the state of combustion within the combustion chamber is not good, the actual calorific value becomes small, and the temperature of water comes to be lower than the set point. On the contrary, if the state of combustion within the combustion chamber is too good, the temperature of water comes to be higher than the set point. The conventional combustion control circuit has the condition of combustion varied with a change in the condition of using a boiler or hot-water supplier. Thus, the conventional combustion control circuit cannot provide optimum combustion that results in gas deleterious to a human body due to imperfect combustion.

SUMMARY OF THE INVENTION

Accordingly, the present invention relates to a combustion control circuit of a combustion apparatus that substantially obviates one or more of the problems due to limitations and disadvantages of the related art.

It is an object of the present invention to provide a combustion control circuit of a combustion apparatus that can control an exhaust fan and a gas valve by detecting the actual state of combustion within its combustion chamber for the purpose of compensating for a difference between the actual combustion state and its reference state and providing optimum combustion so that exhaust emissions can be minimized and the temperature of water can be exactly controlled to a set point.

To achieve these and other advantages and in accordance with the purpose of the present invention, as embodied and broadly described, the inventive combustion control circuit of a combustion apparatus having a driving signal generator for producing a driving signal for an exhaust fan and a gas valve in response to each output signal of a temperature sensor and a flow sensor, an exhaust fan controller for outputting a control signal for the exhaust fan in response to the output signal of the driving signal generator, and a gas valve controller for producing a control signal for the gas valve in response to the output signal of the driving signal generator. The inventive combustion control circuit includes a combustion state detector for detecting the state of combustion occurring within a combustion chamber according to an output signal of a flame sensor installed in the combustion chamber and for producing a signal corresponding to the state of combustion; a reference signal generator for producing a reference signal in response to each output signal of the temperature sensor and the flow sensor; a comparator for comparing the output signal of the combustion state detector with the output signal of the reference signal generator, and for outputting a signal corresponding to a difference therebetween; and an adder for adding the output signal of the comparator to the output signal of the driving signal generator, and for respectively applying an output to each one of the exhaust fan controller and the gas valve controller.

BRIEF DESCRIPTION OF THE ATTACHED DRAWINGS

DETAILED DESCRIPTION OF PREFERRED EMBODIMENT

A preferred embodiment of the present invention is now described in detail with reference to the accompanying drawings.

Figure 1:
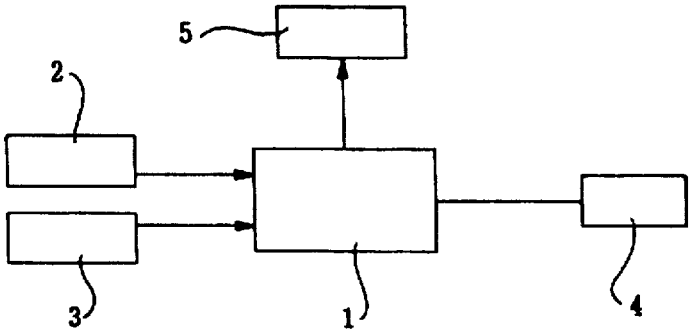
FIG. 1 is a block diagram of a combustion control device of a typical combustion apparatus that is capable of controlling combustion.
Figure 3:
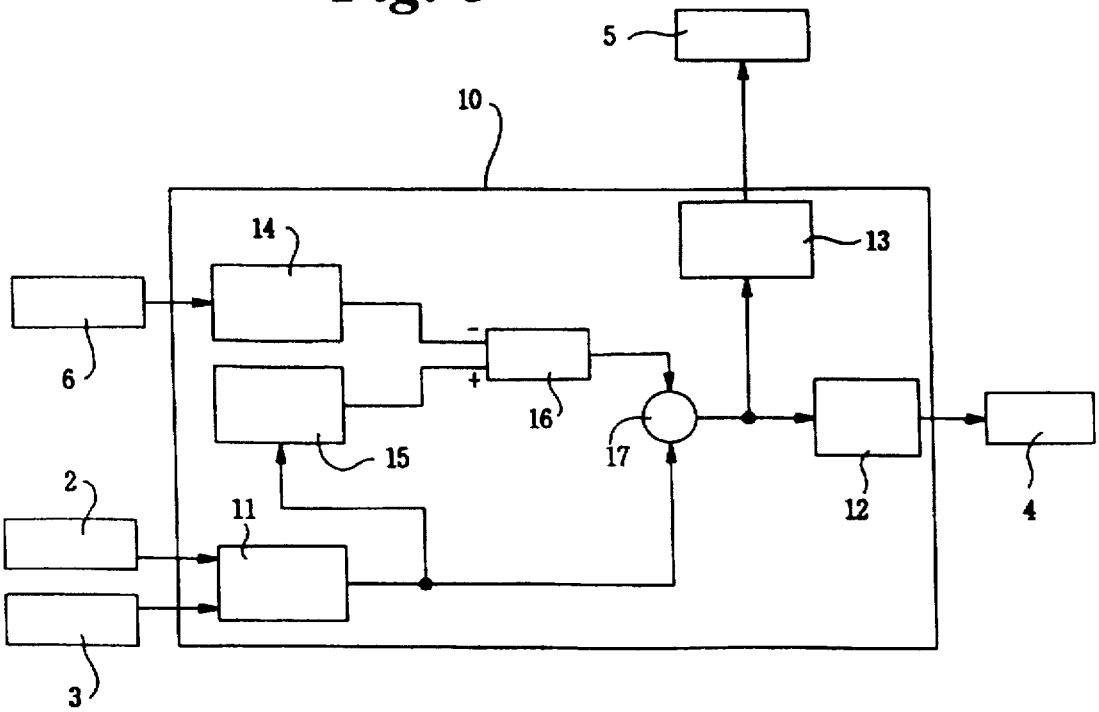
FIG. 3 is a block diagram of the combustion control circuit of a combustion apparatus in accordance with the present invention.
Figure 2:
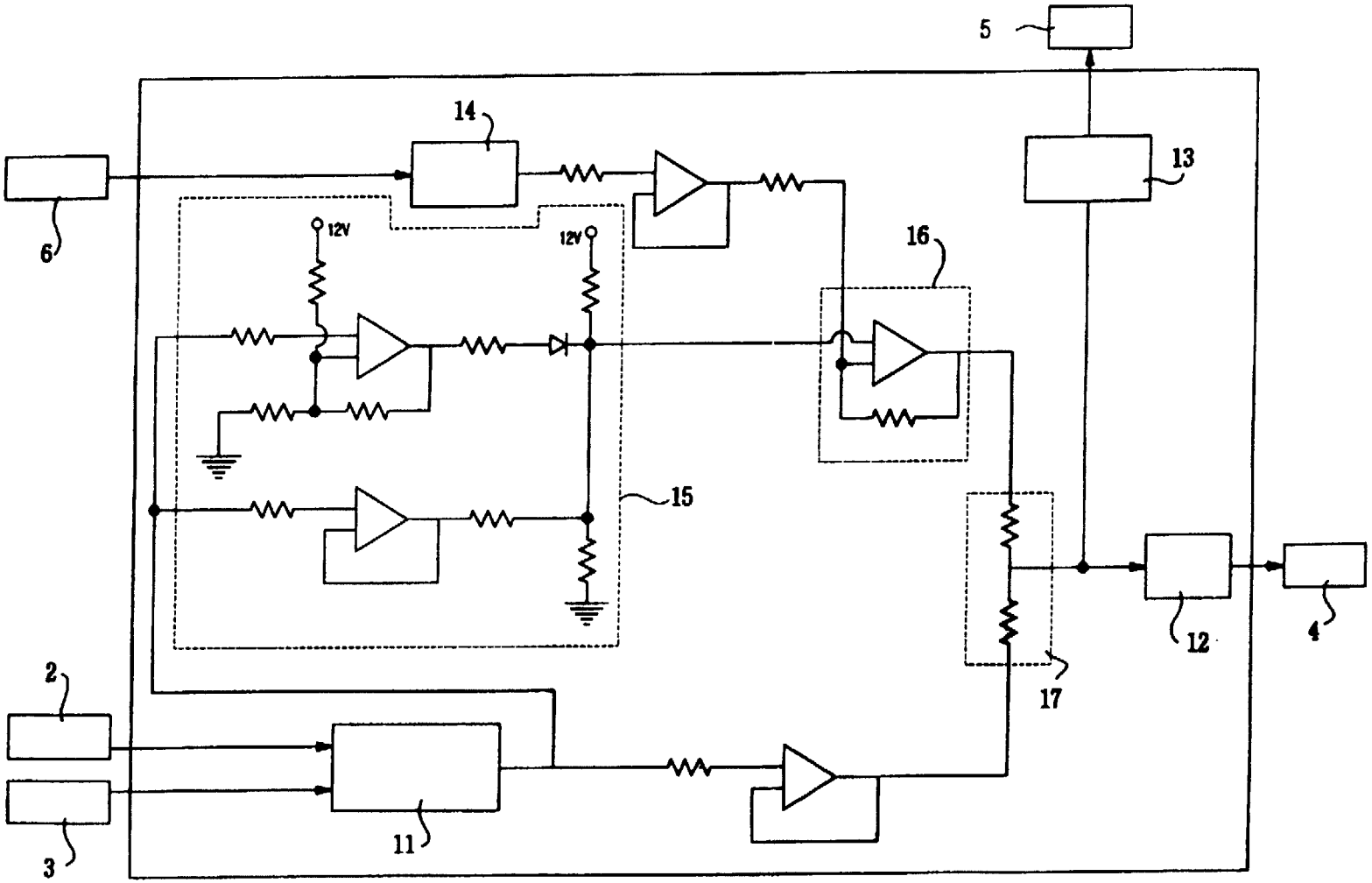
FIG. 2 is a circuit diagram of a combustion control circuit of a combustion apparatus in accordance with the present invention.

Referring to FIGS. 2 and 3, a combustion control circuit of a combustion apparatus of the present invention includes driving signal generating means 11 producing a driving signal for an exhaust fan 4 and a gas valve 5 in response to each output signal of a temperature sensor 2 and a flow sensor 3, exhaust fan controlling means 12 outputting a control signal for the exhaust fan 4 in response to the output signal of the driving signal generating means 11, and gas valve controlling means 13 producing a control signal for the gas valve 5 in response to the output signal of the driving signal generating means 11.

The combustion control circuit of the present invention further comprises combustion state detecting means 14 for detecting the state of combustion occurring within a combustion chamber according to an output signal of a flame sensor 6 installed in the combustion chamber, and for producing a signal corresponding to the state of combustion; reference signal generating means 15 for producing a reference signal in response to each one of the output signals of the temperature sensor 2 and the flow sensor 3; comparing means 16 for comparing the output signal of the combustion state detecting means 14 with the output signal of the reference signal generating means 15, and for outputting a signal corresponding to a difference therebetween; and adding means 17 for adding the output signal of the comparing means to the output signal of the driving signal generating means 11 and for respectively applying an output to each one of the exhaust fan controlling means 12 and the gas valve controlling means 13. The combustion control circuit of the present invention constructed as above operates as below.

Driving signal generator 11 produces a driving signal for controlling exhaust fan 4 and gas valve 5 in response to signals generated from temperature sensor 2 and flow sensor 3, like that of a conventional art technique. The driving signal is not directly applied to exhaust fan controller 12 and gas valve controller 13 but is compensated according to the state of combustion to be input to the exhaust fan controller 12 and the gas valve controller 13.

Combustion state detector 14 detects a signal corresponding to the combustion of state in response to a signal produced from flame sensor 6, and the better the state of combustion is, the higher a voltage signal generated by the combustion state detector 14 becomes in level.

Reference signal generator 15 produces a reference signal in response to each signal produced from the temperature sensor 2 and the flow sensor 3. The higher each level of the signals generated from the temperature sensor 2 and the flow sensor 3 is (a voltage signal produced from the temperature sensor attains a high level in inverse proportion to the temperature of water), the higher a voltage of the reference signal produced from the reference signal generator 15 becomes.

Comparator 16 compares an output signal of the combustion state detector 14 with that of the reference signal generator 15, and produces a signal corresponding to the difference therebetween. If the signal of the combustion state detector 14 is higher in level than that of the reference signal generator 15, the comparator 16 generates a signal attaining a negative level, and if the signal of the combustion state detector 14 is lower in level than that of the reference signal generator 15, the comparator 16 generates a signal that attains a positive level.

Adder 17 adds a signal produced from the driving signal generator 11 to that from the comparator 16, and produces an output to each one of the exhaust fan controller 12 and the gas valve controller 13. When the state of combustion is too good ((violent), the signal produced from the comparator 16 attains a negative level, and the adder 17 controls the output signal of the driving signal generator 11 to a low level. On the contrary, when the state of combustion is not good (weak), the signal produced from the comparator 16 attains a positive level, and the adder 17 controls the output signal of the driving signal generator 11 to a high level.

As mentioned above, when the state of combustion within the combustion chamber is too good, the present invention reduces the amount of air and gas that are respectively supplied by the exhaust fan 4 and the gas valve 5, and when the state of combustion within the combustion chamber is not good, the present invention increases the amount of air and gas that are respectively supplied by the exhaust fan 4 and the gas valve 5 so that the combustion apparatus can have an adequate calorific value. The present invention detects the actual state of combustion, and controls the exhaust fan 4 and the gas valve 5 so as to compensate for a difference between a reference combustion state and the actual state thereof, which makes possible exactly controlling the temperature of water to a set point.

It will be apparent to those skilled in the art that various modifications and variations can be made in the combustion control circuit of the present invention without departing from the spirit or scope of the invention. Thus, it is intended that the present invention covers the modifications and variations of this invention, provided they come with the scope of the appended claims and their equivalents.

What is claimed is:

1. A combustion control circuit of a combustion apparatus including driving signal generating means producing a driving signal for an exhaust fan and a gas valve in response to each output signal of a temperature sensor and a flow sensor, exhaust fan controlling means outputting a control signal for the exhaust fan in response to the output signal of said driving signal generating means, and gas valve controlling means producing a control signal for the gas valve in response to the output signal of the driving signal generating means, said combustion control circuit comprising:

combustion state detecting means for detecting the state of combustion occurring within a combustion chamber according to an output signal of a flame sensor installed in the combustion chamber, and for producing a signal corresponding to the state of combustion;

reference signal generating means for producing a reference signal in response to each one of the output signals of the temperature sensor and the flow sensor;

comparing means for comparing the output signal of said combustion state detecting means with the output signal of said reference signal generating means, and for outputting a signal corresponding to a difference therebetween; and adding means for adding the output signal of said comparing means to the output signal of said driving signal generating means and for respectively applying an output to each one of the exhaust fan controlling means and the gas valve controlling means.

* * * * *